United States Patent [19]

Sutcliffe

[11] Patent Number: 4,848,943

[45] Date of Patent: Jul. 18, 1989

[54] METHOD AND APPARATUS FOR ENERGIZING A PRINTHEAD

[75] Inventor: David W. Sutcliffe, Fremont, Wyo.

[73] Assignee: Micro Peripherals, San Diego, Calif.

[21] Appl. No.: 37,496

[22] Filed: Apr. 13, 1987

[51] Int. Cl.[4] ..... B41J 9/38; B41J 3/12

[52] U.S. Cl. ..... 400/124; 101/93.03; 361/152; 400/157.3; 400/166

[58] Field of Search ..... 400/54, 166, 121, 120, 400/124, 157.3; 101/93.03–93.05; 361/152–156; 346/76 PH

[56] References Cited

U.S. PATENT DOCUMENTS

| | | | |
|---|---|---|---|
| 4,230,411 | 10/1980 | Grottrup | 400/121 |
| 4,350,449 | 9/1982 | Countryman | 400/120 |
| 4,389,935 | 6/1983 | Arai | 400/120 X |
| 4,464,669 | 8/1984 | Sekiya | 400/120 X |
| 4,503,480 | 3/1985 | Pickard | 361/152 |
| 4,566,813 | 1/1986 | Kobayashi | 400/121 X |
| 4,567,488 | 1/1986 | Moriguchi | 346/1.1 X |
| 4,663,734 | 5/1987 | Beary | 364/900 |
| 4,664,542 | 5/1987 | Tsugita | 400/124 |
| 4,674,897 | 6/1987 | West | 400/124 |

FOREIGN PATENT DOCUMENTS

| | | | |
|---|---|---|---|
| 68975 | 4/1985 | Japan | 400/54 |

*Primary Examiner*—Paul T. Sewell

*Attorney, Agent, or Firm*—Watts, Hoffmann, Fisher & Heinke Co.

[57] ABSTRACT

A method and apparatus for energizing a printhead by maintaining substantially constant peak current in the actuator means of the printhead regardless of the duty cycle of the actuator means. The method and apparatus establishes a minimum time period for energizing the actuator means and a supplemental time period for energizing the actuator means in response to the determined duty cycle. The actuator means are then energized for an extended time period in dependence upon the minimum time period and the established supplemental time period to thereby maintain substantially constant peak current in the actuator means regardless of the duty cycle thereof.

19 Claims, 3 Drawing Sheets

PRINTHEAD DRIVE PULSE

METHOD AND APPARATUS FOR ENERGIZING A PRINTHEAD

TECHNICAL FIELD

The present invention relates to a method and apparatus for energizing a printhead and more particularly to a method and apparatus for maintaining substantially constant peak current in the actuator means of the printhead regardless of the duty cycle of the actuator means.

BACKGROUND ART

Apparatus and methods for energizing a printhead are well known in the prior art. In the prior art when utilizing a power supply to energize a printhead, such as a dot matrix impact printhead, and more particularly when using an unregulated bi-level voltage drive, the power supply voltage fluctuates due to changing printhead duty cycle. As the duty cycle increases the voltage output of the power supply tends to decrease. The voltage change which can be in the range of 5 to 7 volts can reduce the coil current in the printhead actuators by as much as 25 percent. Reduction in coil current reduces the energy available to actuate the printhead and degrades the print quality.

In the known prior art, the printheads include a plurality of actuators, such as coils, which are periodically energized by pulses of power to actuate the printhead and effect printing. As the duty cycle of the actuators increases, the voltage available to the actuators from the power supply decreases and the coil current also decreases with a resulting decrease in available actuator energy. To offset the problem of decreasing voltage and current in the printhead actuators, the "time on" for the printhead actuators must be increased in order to maintain substantially constant peak current in the printhead actuators. The prior art attempts to solve this problem by utilizing a one-shot multivibrator to monitor the voltage pulses through the printhead and to lengthen the voltage pulses in response to a decreasing voltage. Thus, the prior art corrects the problem by monitoring the supply voltage and increasing the "time on" for the voltage pulse with a multi-vibrator wherein the "time on" is dependent upon the sensed supply voltage. In such prior art apparatus, expensive and space consuming circuitry must be utilized to monitor the supply voltage and control the pulse width from the multivibrator.

The present invention overcomes the disadvantage of the prior art by not directly sensing supply voltage drop. The present invention senses the duty cycle of the printhead and estimates the supply voltage drop in dependence upon the sensed duty cycle. It is assumed that the supply voltage drops as the duty cycle increases. The length of the pulses for energizing the actuators of the printhead is then modified in dependence upon the sensed duty cycle of the printhead. No monitoring of the supply voltage occurs in the present invention.

DISCLOSURE OF THE INVENTION

The present invention provides a new and improved method and apparatus for energizing a printhead including a plurality of actuator means each of which is adapted to be periodically energized from a power supply to effect printing and maintaining substantially constant peak current in each of the plurality of actuator means regardless of the duty cycle of the plurality of actuator means.

The present invention provides a new and improved method of energizing a printhead including a plurality of actuator means energized from a power supply including the steps of providing a source of power, periodically energizing selective actuator means of the plurality of actuator means by the source of power, establishing a minimum time period for energizing each of the selected actuator means, determining the duty cycle of the selected actuator means, establishing a supplemental time period for energizing the selected actuator means in response to the determined duty cycle, determining an extended time period for energizing the selected actuator means in dependence upon the minimum time period and the established supplemental time period and energizing the selected actuator means for the extended time period to maintain substantially constant peak current in the plurality of selected actuator means regardless of the duty cycle of the actuator means.

A further provision of the present invention is to provide a new and improved method of energizing a printhead as is set forth in the preceding paragraph wherein the step of determining the duty cycle of the actuator means includes the steps of sensing the number of actuations of the plurality of selected actuator means during a predetermined time period and calculating the duty cycle in dependence upon the sensed number of actuations of the actuator means.

Still another provision of the present invention is to provide a new and improved method of energizing a printhead as set forth in the preceding paragraph further including the step of projecting the voltage drop in the supply voltage from the power supply in dependence upon the calculated duty cycle of the selected actuator means.

Another provision of the present invention is to provide a new and improved method of energizing a printhead including actuator means adapted to be periodically energized by a pulse of power from a power supply including the steps of providing a source of power, providing a plurality of periodic pulses of power from the power supply for energizing the actuator means, determining the duty cycle of the actuator means, establishing a time period for the pulses of power from the power supply for energizing the actuator means in response to the determined duty cycle, and energizing the actuator means for the established time period to maintain substantially constant peak current in the actuator means regardless of the duty cycle of the actuator means.

A still further provision of the present invention is to provide a new and improved apparatus for energizing a printhead including a plurality of actuator means each of which is adapted to be periodically energized to effect printing, the apparatus including a source of power for periodically providing a pulse of power for energizing selected actuator means from the source of power, sensor means for sensing the duty cycle of the selected actuator means, control means operatively associated with the source of power and the sensor means for establishing a time period dependent upon the sensed duty cycle for each of said pulses of power for periodically energizing each of the selected actuator means, and wherein the control means determines an extended time period for each of the pulses of power for energizing the selected actuator means in dependence upon an increase in the sensed duty cycle of the actuator means and energizes the selected actuator means for the extended time period to maintain substantially constant peak current in the actuator means regardless of the duty cycle of the actuator means.

BRIEF DESCRIPTION OF THE DRAWINGS

FIG. *3a* is a graphical representation of the power supply voltage; FIG. *3b* illustrates the current through the actuator means on the printhead without the pulse width control of the present invention

DESCRIPTION OF THE PREFERRED EMBODIMENT

The present invention provides a method and apparatus for energizing a printhead of a printer mechanism such as disclosed in U.S. Pat. Nos. 4,218,151 and 3,900,094 which are incorporated herein by reference. While the method and apparatus of the present invention will be described with respect to a dot matrix impact printer, it should be appreciated that the method and apparatus could be utilized with other types of printers such as a thermal printer, wherein the voltage from the power supply drops as the duty cycle of the printhead is increased.

Figure 1:
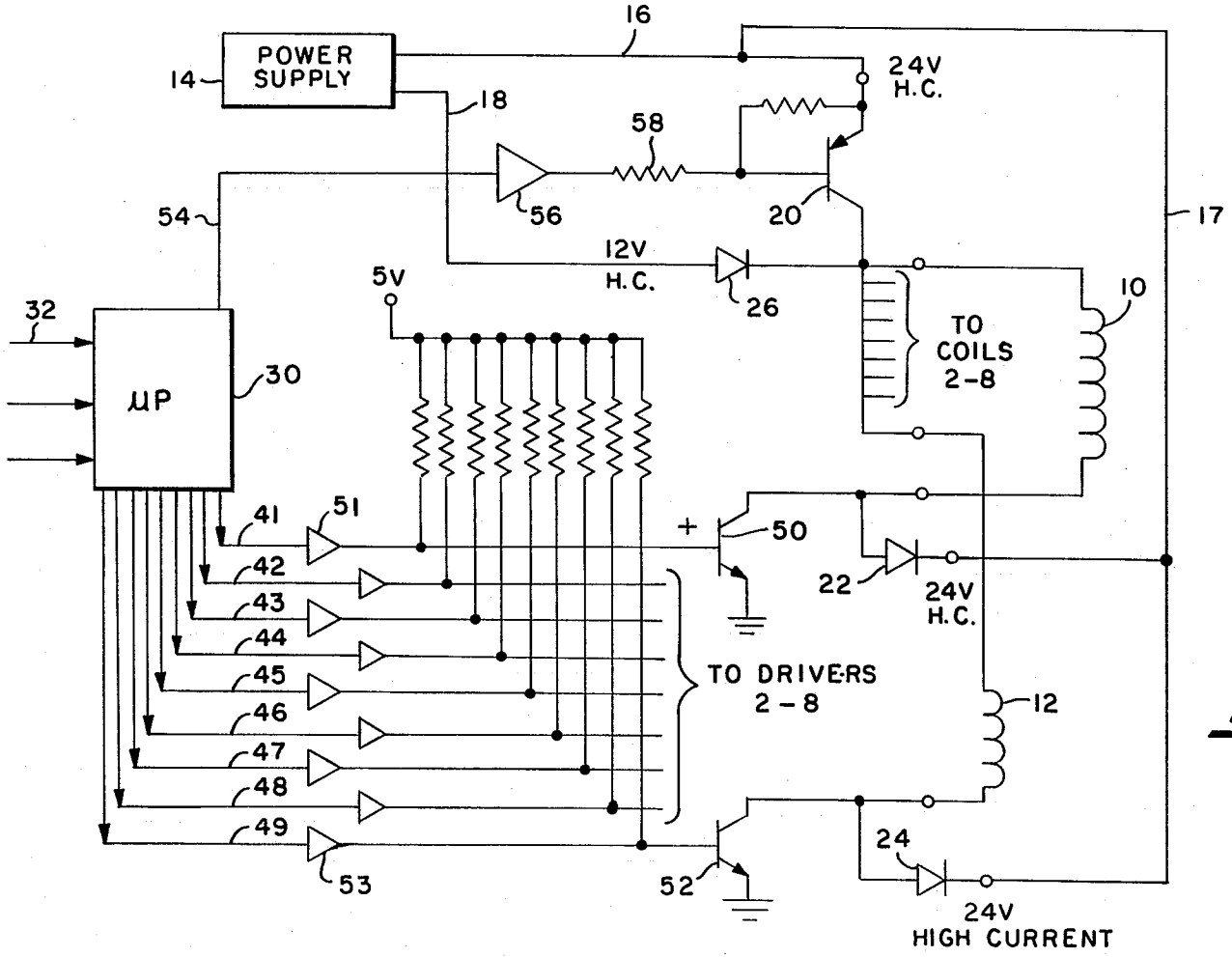
FIG. 1 is a schematic representation of the circuitry for energizing a printhead according to the method of the present invention.

Referring to FIG. 1, circuitry is disclosed for practicing the method of the present invention. The circuitry provides for the energization of coils 10, 12 from a power supply 14. The coils 10 and 12 comprise two of a plurality of coils which form the actuator means for a dot matrix impact printhead (not illustrated) whose construction is well known in the art. When coil 10 is energized, a print wire associated therewith (not illustrated) will be driven by the coil 10 into contact with a print medium to effect printing in a well known manner. In the preferred embodiment, the printhead utilizes 9 print wires and 9 separate coils each of which is associated with one of the print wires to effect actuation thereof. For purposes of illustration, only two coils 10 and 12 are disclosed in FIG. 1. However, it should be realized that additional coils, not illustrated, will be utilized in the preferred embodiment.

Power supply 14 is a bi-level power supply and provides a source of high voltage high current on a line 16 and low voltage, high current on line 18. The high current on line 16 is in the preferred embodiment a 24 volt supply which is directed to an emitter of a PNP transistor 20 and to the cathode of diodes 22 and 24 via line 17. The 12 volt high current on line 18 is in the preferred embodiment a 12 volt supply which is directed to the anode of diode 26 which has its cathode connected to the coils 10 and 12 of the printhead.

The power supply 14 is a bi-level power supply which is adapted to selectively energize the plurality of actuator means (coils) 10, 12 of the printhead. A control means in the form of a microprocessor 30 is provided for controlling the energization of the coils 10, 12 and for calculating an approximation of the duty cycle of the plurality of coils 10, 12 which are selectively actuatable.

The microprocessor 30 includes a plurality of outputs 41–49 each of which is associated with one of the coils of the printhead. The microprocessor 30 is operable to control the selective actuation of the coils 10, 12 of the printhead. For illustrative purposes, output 41 is associated with coil 10 and output 49 is associated with coil 12. The remaining outputs 42–48 will be associated with coils or other actuator means, not illustrated. The output 41 of microprocessor 30 is connected to the base of an NPN transistor 50 through a driver 51 and the output 49 is connected to the base of an NPN transistor 52 through driver 53. The collector emitter circuit of transistor 50 is connected in series with the coil 10 and the collector emitter circuit of transistor 52 is connected in series with the coil 12. When transistor 50 is conductive and transistor 20 is non-conductive, a 12 volt high current will be passed through coil 10 from the output 18 of the power supply 14 and when transistor 52 is conductive and transistor 20 is non-conductive, a 12 volt high current will be directed from output 18 of the power supply 14 through the coil 12.

The microprocessor 30 also includes an output 4 which is connected to gate 56 whose output is connected through the resistor 58 to the base of transistor 20. The gate 56 synchronizes the current with the output pulse on output 54 of the microprocessor 30.

Figure 2A:
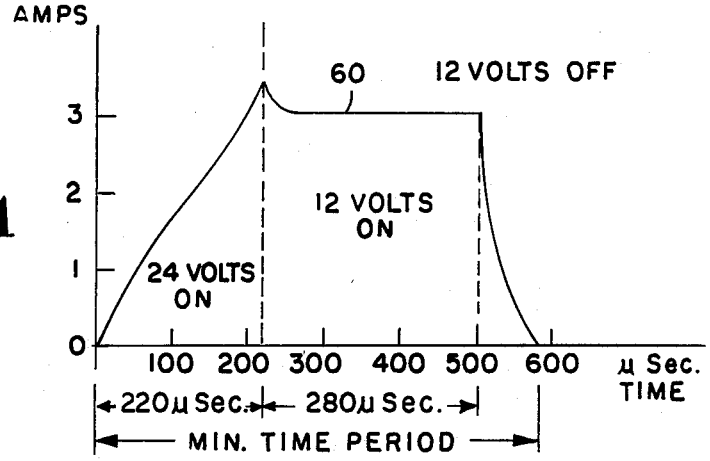
FIG. 2 is a graphical illustration of current pulses from the power supply used to energize the actuator means of the printhead wherein FIG. *2a* is a typical pulse from a non-regulated bi-level power supply; FIG. *2b* is a typical degraded pulse with no compensation and FIG. *3c* is a modified corrected pulse resulting from the method and apparatus of the present invention.
Figure 2B:
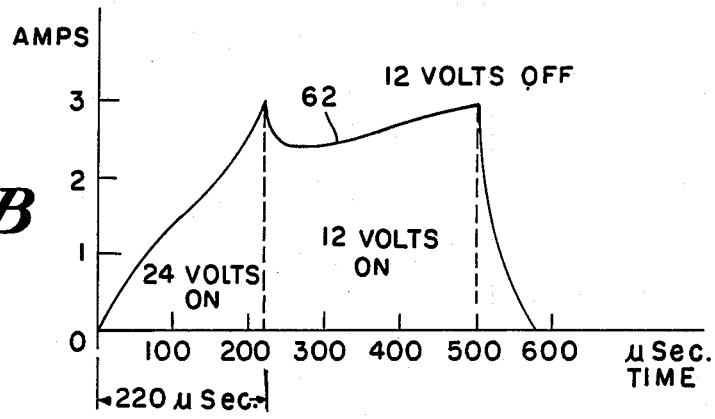

In order to energize a coils 10, 12 of the printhead with a pulse of high voltage, high current as is illustrated in FIG. 2, transistor 20 must be conductive and one of the transistors 50, 52 must also be simultaneously conductive. This requires the microprocessor 30 to establish a signal on line 54 which directs a low to the base of transistor 20 causing transistor 20 to become conductive and a signal on output 41 which applies a high to the base of transistor 50 to effect conduction of transistor 50. When transistors 20 and 50 are rendered conductive by the microprocessor 30, a 24 volt high current will be directed through the emitter collector circuit of transistor 20, through coil 10 and through transistor 50 to ground. When transistor 20 and transistor 50 are conductive, a high current voltage pulse 60, as is illustrated in FIG. *2a*, will pass through the printhead coil 10 to effect actuation thereof.

When using the bi-level power supply 14, the printhead coils are activated by the 24 volt path for a predetermined period which in the preferred embodiment is 220 micro seconds and is seen in FIG. 2 and then reduced to 12 volts for a second predetermined period which in the preferred embodiment is about 280 micro seconds. This is accomplished by rendering transistors 20 and 50 conductive for 220 micro seconds and then extinguishing conduction of transistor 20 while maintaining conduction of transistor 50 for an additional 280 microseconds. Utilizing an ideal voltage supply 14 and load 10, the pulse through coil 10 resembles pulse 60 in FIG. *2a*. A quick ramping occurs as the 24 volt voltage path through transistor 20 is actuated followed by a levelling off of current when the 24 volt voltage path is de-actuated by rendering transistor 20 non-conductive and the 12 volt voltage path is maintained. Thus, in the circuitry illustrated in FIG. 1, microprocessor 30 will establish a signal on line 54 to turn on transistor 20 for about 220 micro seconds while simultaneously establishing a signal on line 41 to turn on transistor 50. After 220 micro seconds, transistor 20 will turn off and transistor 50 will continue to conduct for an additional 280 micro seconds. At this time, the 12 volt supply will be directed across the coil 10 from line 18. When it is desired to turn off coil 10, transistor 50 is turned off. When transistor 50 is turned off, coil 10 does not immediately cease conduction due to its inductance. The inductance in coil 10 continues to supply current to the non-conducting transistor 50. The induced current is directed through the diode 22 back to the power supply 14.

When using a non-regulated power supply 14, the supply voltage will not be constant and will vary according to the load current. In a no-load condition, the power loss due to the transformer windings of the power supply (not illustrated) is almost zero, but as the current increases, the power loss across the transformer windings increases due to its impedance. Additionally, the voltage output of the power supply 14 will decrease when the duty cycle of the printhead increases and the number of pulses required from the power supply for a predetermined time period increases. It is important to maintain constant or substantially constant power to all of the printhead coils to avoid "dropouts" a condition in which the printhead coil does not fully actuate the print wire due to insufficient power from the power supply. A decrease in voltage at the power supply will decrease peak current in the printhead coils which if not corrected could result in "dropouts". A typical current pulse wherein the peak current is decreased due to a drop in the supply voltage effected by an increased duty cycle of the printhead actuators is disclosed at 62 in FIG. 2*b*.

Figure 2C:
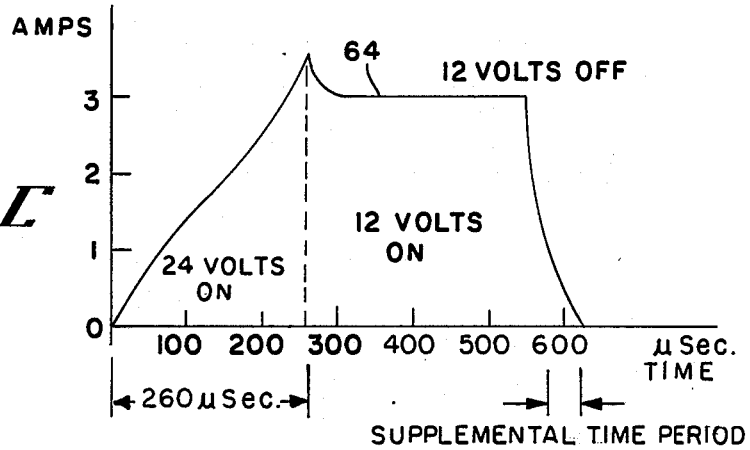

To avoid the problem of reduced coil current due to changing printhead duty cycles, the "on time" of the current pulse illustrated in FIG. 2 must be increased to maintain constant power to all the printhead coils to avoid drop out or the on time for only the 24 volt portion of the pulse must be increased. The power delivered by the pulse to the printhead actuators is proportional to the area under the pulse curve. It is desirable to maintain substantially constant power to the actuators. Thus, the area under pulse 60 should be at least equal to the area under pulse 64. Pulse 64, illustrated in FIG. 2C, discloses an extended "on time" wherein the "on time" is increased to maintain substantially constant peak current in the energized coil of the printhead. Rather than extending the "on time" for pulse 64, the area under the pulse or the power to the printhead can be increased by increasing the duration of the application of the 24 volt power to the printhead while maintaining the length of the pulse substantially constant. An increase in the "on time" for the 24 volt supply increases the area under the pulse and thus increases the power available to energize the printhead.

The method of the present invention utilizes an approximation to determine the increase in pulse width "on time" or the "on time" of the 24 volt high current which will be needed to achieve a constant peak current as the duty cycle of the printhead varies. The method establishes a minimum time period which is exemplified by the width of pulse 60 in FIG. 2*a* for periodically energizing each of the selected coils of the printhead. A supplemental time period and/or an increase in the "on time" of the 24 volt high current, illustrated in FIG. 2*c*, is also established in response to the sensed duty cycle of the actuator means (coils) of the printhead. As the duty cycle increases, the supplemental time period will increase. The actuator means of the printhead are then actuated for an extended time period which is equal to the minimum time period plus the supplemental time period which is established in response to the determine duty cycle. The extended time period is determined to maintain a substantially constant peak current and constant power in the plurality of selected coils for the printhead regardless of the duty cycle.

While FIG. 2C illustrates extending the pulse width, it should be appreciated that by extending the "on time" for the 24 volt high current, the area under the pulse can be increased without extending the pulse width and it is within the scope of the present invention to a) increase the pulse width to maintain constant power to the printhead, b) increase the "on time" of the 24 volt high current to the printhead without increasing the pulse width on c) increasing the "on time" of the 24 volt high current and increasing the pulse width. In each case, the area under the pulse is maintained substantially constant to provide substantially constant power to energize the actuator means of the printhead.

The duty cycle of the coils of the printhead is approximated by totaling the number of actuations in a predetermined time period. In "determining the duty cycle, it is assumed that every time a coil of the printhead is energized, it is energized for a fixed predetermined time period. The number of actuations of the coil over a predetermined time period will then yield an approximation of the duty cycle of the printhead.

In the preferred embodiment, a slotted code wheel of a known construction, not illustrated, can be utilized for positioning of the printhead relative to the print medium in a well known manner. Each slot of the code wheel will be representative of a printhead position. In the present embodiment, the microprocessor 30 counts a time period of 20 clock periods for approximating the duty cycle of the actuator means of the printhead. The microprocessor 30 then senses the total number of actuations of the plurality of selected coils of the printhead in the 20 clock periods. (Assuming that the printhead utilizes 9 wires, the maximum number of actuations in 20 clock periods would be 90 since the maximum frequency of actuation of the actuators would be every other period, i.e. 9 wires times 10 periods equals 90. (Different calculations would result from using a different number of wires.) The microprocessor 30 counts the number of actuations during the period and then performs two "rotate right" commands on the number which essentially divides the total number of actuations by four. The microprocessor 30 then sums this new number with a variable representing the previous approximations sensed during previous time periods of 20 clocks each. The grand total is then added to the printhead pulse width for the next 20 clock periods. After that, the number is again divided by two and summed with another total indicative of the number of actuations in the last 20 clock periods. Mathematically, this can be represented as follows:

$$\text{Time added to pulse} = \frac{TDOTS}{4} + \frac{TDOTS}{8}1 + \frac{TDOTS}{16}2 + \frac{TDOTS}{32}3 + \frac{TDOTS}{64}4$$

$$\text{Where } PWIDTH = \frac{TDOTS}{8}1 + \frac{TDOTS}{16}2 +$$

-continued $$\frac{TDOTS}{32}\,3 + \frac{TDOTS}{64}\,4$$

and each increasing subscript on TDOTS represents a previous approximation. PWIDTH is the variable representing previous approximations. Since each previous approximation is subesequently divided by 2 for each new approximation, it should be apparent that the present method attaches decreasingly less significance to previous approximations while the new clock periods are counted.

As an example, assume that the print mechanism is first "turned on" and the mechanism is told to print a solid block, 9 dots high. The variable PWIDTH and TDOTS will start off as zero due to the fact that no dots have been previously printed. As printing occurs, TDOTS will begin to accumulate until after 20 clock periods, TDOTS will equal 90. If TDOTS equal 90, then $$\frac{TDOTS}{4}$$

equals 22 (trunkcated to lower integer). Since the time added to a pulse equals, $$\frac{TDOTS}{4} + PWIDTH$$

and PWIDTH initially equals 0, then 22 plus PWIDTH will equal 22 which is the number (in microseconds) added to the print pulse for the next 20 clock periods. This number is indicative of the supplemental time period for energizing each of the selected actuator means or of the extended "on tine" for the 24 volt high current. After twenty more clock periods, (40 clock periods into a line) the new TDOTS which is also 90 is divided by 4 and added to the old approximation divided by 2, i.e. 22 plus 11 equals 33. This new number, 33 (microseconds), is then added to the pulse width or the "on time" for the 24 volt high current for the next 20 clocks until a new approximation is made.

It should be realized that after five approximations the grand total while printing a solid block will saturate at a constant number. This number is indicative of the maximum supplemental time period or "on time" for the 24 volt high current which will be utilized to energize each of the selected actuator means in response to the printhead operating at its maximum duty cycle. Additionally, for different applications, the number of clocks per period could be varied along with varying the times TDOTS is shifted right (divided by 2). While the approximation is not perfect, it offers compensation and is relatively simple from a cost and technology standpoint to implement. Additionally, while the invention has been disclosed as sensing and counting the number of actuations of the printhead during a predetermined time period, it is also contemplated that the invention of the present application could sense projected actuation of the printhead from a storage register prior to the actual actuation of the printhead and could be utilized to expand the pulse widths based on projected rather than sensed duty cycle.

Figure 3:
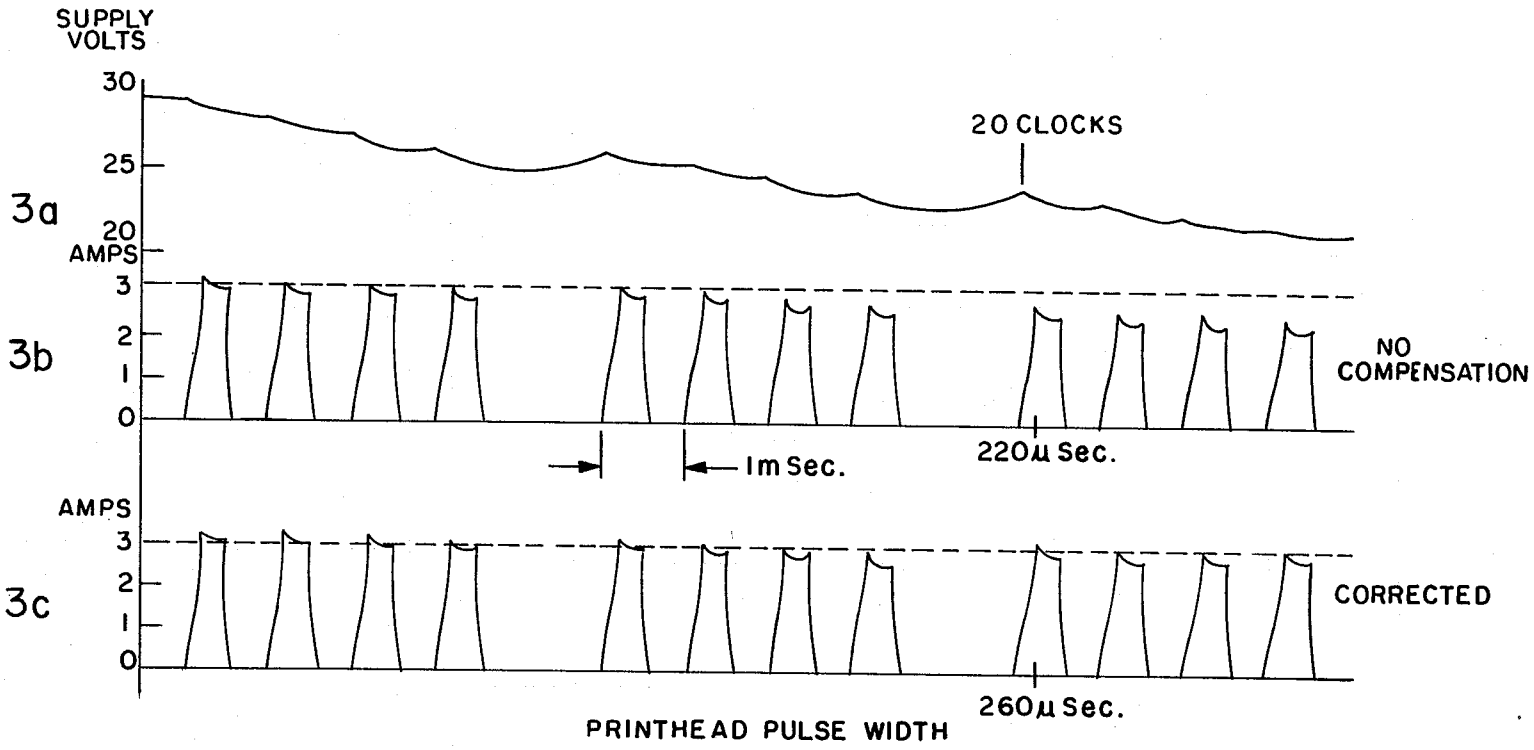
FIG. 3C illustrates the current through the actuator means of the printhead with the pulse width control of the present invention.

FIG. 3*a* discloses the voltage output from the power supply 14. FIG. 3*b* discloses the current trace though a typical coil 10 of the printhead without the pulse width control of the present invention. In FIG. 3*b*, it can be seen tat the current peaks are not uniform and are dependent upon the voltage output from the power supply 14. FIG. 3*c* illustrates the current through a typical printhead coil when the pulse width control of the present invention is utilized to extend the width of the pulses of current to the printhead. It can be seen in FIG. 3*c* that the current peaks through the coil are much more uniform than in FIG. 3*b*. The uniformity of the current peaks with the pulse width control insures that constant peak current is available to actuate the coils 10 of the printhead regardless of the duty cycle of the printhead.

From the foregoing it should be apparent that a new and improved method and apparatus for energizing a printhead including a plurality of actuator means each of which is adapted to be periodically energized from a power supply to effect printing has been provided wherein substantially constant peak current in each of the plurality of actuator means is provided regardless of the duty cycle of the plurality of actuator means.

What is claimed is:

1. A method of energizing a printhead including a plurality of actuator means each of which is adapted to be periodically energized from a power supply to effect printing and maintaining substantially constant peak current in each of said plurality of actuator means regardless of the duty cycle of said plurality of actuator means comprising the steps of:

providing a source of power for periodically energizing selected actuator means of said plurality of actuator means;

periodically energizing selected actuator means of said plurality of actuator means to effect printing;

establishing a minimum time period for periodically energizing each of said selected actuator means from said source of power;

determining the duty cycle of said selected actuator means;

establishing a supplemental time period for energizing each of said selected actuator means in response to the determined duty cycle of said plurality of selected actuator means;

determining an extended time period for energizing said selected actuator means in dependence on said minimum time period and said established supplemental time period; and energizing said selected actuator means for said extended time period to maintain substantially constant peak current in said plurality of selected actuator means regardless of the duty cycle of said actuator means.

2. A method of energizing a printhead as defined in claim 1, wherein said step of determining the duty cycle of said actuator means includes the steps of:

sensing the number of actuations of said plurality of selected actuator means over a predetermined time period; and calculating the duty cycle of said selected actuator means in dependence upon the sensed number of actuations of said plurality of selected actuator means during said predetermined time period.

3. A method of energizing a printhead as defined in claim 1, wherein said step of determining the duty cycle of said selected actuator means includes the steps of:

determining the number of actuations of the selected plurality of actuating means which are to be selectively energizable during a predetermined time period; and calculating the duty cycle of said selected actuating means in dependence upon the determined number of actuations of the selected plurality of actuator means during the predetermined time period.

4. A method of energizing a printhead as defined in claim 2, further including the step of:

projecting the voltage drop in the supply voltage from the power supply in dependence upon the calculated duty cycle of said selected actuator means.

5. A method of energizing a printhead as defined in claim 4, wherein said step of establishing said supplemental time period includes the steps of:

establishing a supplemental time period in dependence upon the projected voltage drop in the supply voltage, said supplemental time period when added to said minimum time period for energizing said selected actuator means enabling said selected actuator means to be energized by said power supply for said extended time period while maintaining substantially constant peak current in each of said selected actuator means as the voltage of said power supply drops due to an increasing duty cycle of said plurality of selected actuator means.

6. A method of energizing a printhead as defined in claim 3, further including the step of projecting the voltage drop in the supply voltage from said power supply in dependence upon the calculated duty cycle of said selected actuator means.

7. A method of energizing a printhead as defined in claim 6, wherein said step of establishing said supplemental time period includes the step of:

establishing a supplemental time period in dependence upon the projected voltage drop in the supply voltage, said supplemental time period when added to said minimum time period for energizing said selected actuator means enabling said selected actuator means to be energized by said power supply for said extended time period while maintaining substantially constant peak current in each of said selected actuator means as the voltage of said power supply drops due to an increasing duty cycle of said plurality of selected actuator means.

8. An apparatus for energizing a printhead including a plurality of actuator means each of which is adapted to be periodically energized to effect printing, said apparatus comprising:

a source of power for periodically providing a pulse of power for energizing selected actuator means of said plurality of actuator means;

sensor means for sensing the duty cycle of said selected actuator means;

control means operatively associated with said source of power and said sensor means for establishing a time period in dependence upon the sensed duty cycle for each of said pulses of power for periodically energizing each of said selected actuator means from said source of power;

said control means determining an extended time period for each of said pulses of power for energizing said selected actuator means in dependence upon an increase in the sensed duty cycle of said actuator means and energizing said selected actuator means for said extended time period to maintain substantially constant peak current in said plurality of selected actuator means regardless of the duty cycle of said actuator means.

9. An apparatus for energizing a printhead as defined in claim 8, wherein said control means is operative to establish a minimum time period for each of said pulses of power for periodically energizing each of said selected actuator means from said source of power and a supplemental time period for each of said pulses of power for energizing each of said selected actuator means from said source of power, said control means being operative to determine said extended time period for each of said pulses of power in dependence upon said minimum time period and said supplemental time period.

10. Apparatus for energizing a printhead as defined in claim 8, wherein said sensor means is operable to sense the number of actuations of said selected actuator means over a predetermined time period and said duty cycle sensed by said sensor means is dependent upon the sensed number of actuations of said selected actuation means during said predetermined time period.

11. Apparatus for energizing a printhead as defined in claim 8, wherein said sensor means is operable to determine the number of actuations of the actuator means which are to be energized during a predetermined time period and said duty cycle sensed by said sensor is dependent upon the sensed number of actuations of said actuator means during said predetermined time period.

12. A method of energizing a printhead including actuator means adapted to be periodically energized by a pulse of power from a power supply and maintaining substantially constant peak current in said actuator means regardless of the duty cycle of said actuator means, comprising the steps of:

providing a source of bilevel power for periodically energizing said actuator means with a first level of voltage and with a second level of voltage which is less than said first level of voltage;

providing a plurality of periodic pulses of power from said power supply for energizing said actuator means each of said pulses of power including a first portion in which said first level of voltage is directed from said power supply to said actuator means and a second portion in which said second level of voltage is directed from said power supply to said actuator means;

determining the duty cycle of said actuator means;

establishing a time period for the pulses of power from said power supply to energize said actuator means; and energizing said actuator means with said pulses of power from said power supply for said established time period and modifying the duration of said first portion of said pulse in which said first level of voltage is directed to said actuator means in response to the determined duty cycle of said actuator means to maintain substantially constant peak current in said actuator means regardless of the duty cycle of said actuator means.

13. A method of energizing a printhead as defined in claim 12, wherein said step of modifying the duration of said first portion of said pulse for periodically energizing each of said selected actuator means from said source of power includes the steps:

establishing a minimum time period for the first portion of each of said pulses of power for energizing said actuator means from said source of power;

establishing a supplemental time period for the first portion of each of said pulses of power from said power supply to energize said actuator means in response to the determined duty cycle of said actuator means; and determining an extended time period for the first portion of each of said pulses of power for energizing said actuator means in dependence upon said minimum time period and said established supplemental time period.

14. A method of energizing a printhead as defined in claim 12, further including the step of:

projecting the voltage drop in the supply voltage from the power supply in dependence upon the determined duty cycle of said selected actuator means.

15. A method of energizing a printhead as defined in claim 12, wherein said step of establishing a time period for the pulses of power indicates the steps of:

establishing a minimum time period for each of said pulses of power;

establishing a second minimum time period for the duration of said first portion of each of said pulses of power and extending the second minimum time period for said first portion of each of said pulses of power in response to a determined duty cycle of said actuator means which is increasing.

16. A method of energizing a printhead including actuator means adapted to be periodically energized by a pulse of power from a power supply and maintaining substantially constant peak current in said actuator means regardless of the duty cycle of said actuator means, comprising the steps of:

providing a source of power for periodically energizing said actuator means;

providing a plurality of periodic pulses of power from said power supply for energizing said actuator means;

determining the duty cycle of said actuator means;

establishing a time period for the pulses of power from said power supply to energize said actuator means in response to the determined duty cycle of said actuator means; and energizing said actuator means with said pulses of power from said power supply for said established time period to maintain substantially constant peak current in said actuator means regardless of the duty cycle of said actuator means;

wherein said step of establishing a time period for periodically energizing each of said selected actuator means from said source of power includes the steps of:

establishing a minimum time period for the pulses of power for energizing said actuator means from said source of power;

establishing a supplemental time period for the pulses of power from said power supply to energize said actuator means in response to the determined duty cycle of said actuator means; and determining an extended time period for energizing said actuator means in dependence upon said minimum time period and said established supplemental time period.

17. A method of energizing a printhead as defined in claim 16, further including the step of:

projecting the voltage drop in the supply voltage from the power supply in dependence upon the calculated duty cycle of said selected actuator means.

18. A method of energizing a printhead as defined in claim 17, wherein said step of establishing said supplemental time period includes the steps of:

establishing a supplemental time period in dependence upon the projected voltage drop in the supply voltage, said supplemental time period when added to said minimum time period for energizing said actuator means enabling said actuator means to be energized by said power supply for said extended time period while maintaining substantially constant peak current in said actuator means as the voltage of said power supply drops due to an increasing duty cycle of said actuator means.

19. Method of energizing a printhead including actuator means adapted to be periodically energized by pulse of power from a power supply and maintaining substantially constant peak current in said actuator means regardless of the duty cycle of said actuator means, comprising the steps of:

providing a source of power for periodically energizing said actuator means;

providing a plurality of periodic pulses of power from said power supply for energizing said actuator means;

determining the duty cycle of said actuator means;

establishing a time period for the pulses of power from said power supply to energize said actuator means in response to the determined duty cycle of said actuator means;

energizing said actuator means with said pulses of power from said power supply for said established time period to maintain substantially constant peak current in said actuator means regardless of the duty cycle of said actuator means;

wherein said step of determining the duty cycle of said actuator means includes the steps of:

determining the number of actuations of the actuator means over a predetermined time period; and calculating the duty cycle of said actuator means in dependence upon the determined number of actuations of the actuator means during the predetermined time period; and projecting the voltage drop in the supply voltage from said power supply in dependence upon the calculated duty cycle of said actuator means;

wherein said step of establishing said supplemental time period includes the step of: establishing a supplemental time period in dependence upon the projected voltage drop in the supply voltage, said supplemental time period when added to said minimum time period for energizing said actuator means enabling said actuator means to be energized by said power supply for said extended time period while maintaining substantially constant peak current in said actuator means as the voltage of said power supply drops due to an increase in duty cycle of said actuator means.

* * * * *